United States Patent [19]

Conn

[11] 4,132,150

[45] Jan. 2, 1979

[54] BLAST ACTUATED DETENT

[75] Inventor: Donald J. Conn, Louisville, Ky.

[73] Assignee: The Unites States of America as represented by the Secretary of the Army, Washington, D.C.

[21] Appl. No.: 822,851

[22] Filed: Aug. 8, 1977

[51] Int. Cl.[2] ..... F41F 3/04

[52] U.S. Cl. ..... 89/1.806; 89/1.812

[58] Field of Search ..... 89/1.806, 1.812, 1.816, 89/1.807, 1.808

[56] References Cited

U.S. PATENT DOCUMENTS

| | | | |
|---|---|---|---|
| 2,940,363 | 6/1960 | Hamilton et al. | 89/1.806 |
| 3,076,385 | 2/1963 | Bornhöft | 89/1.806 |
| 3,296,929 | 1/1967 | Jacobson | 89/1.816 X |
| 3,412,640 | 11/1968 | Nash | 89/1.807 X |
| 3,513,749 | 5/1970 | Magnant | 89/1.807 X |
| 3,659,493 | 5/1972 | Wissner | 89/1.807 |
| 3,842,711 | 10/1974 | Bodinaux | 89/1.807 |

FOREIGN PATENT DOCUMENTS

| | | | |
|---|---|---|---|
| 1340562 | 12/1962 | France | 89/1.806 |

*Primary Examiner*—David H. Brown

*Attorney, Agent, or Firm*—Nathan Edelberg; Robert P. Gibson; Harold W. Hilton

[57] ABSTRACT

A detent device that is applicable to rocket launch systems where the rockets must be positively retained on the launcher prior to the time of launch. The device engages a detent groove in the rocket and restrains the rocket from any forward motion until launch at which time a cam lifts the detent out of the groove thereby releasing the rocket.

1 Claim, 1 Drawing Figure

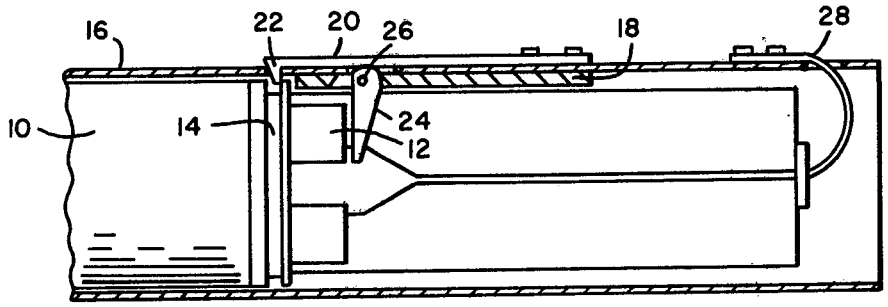
16
22
20
26
18
28
10
14
24
12

BLAST ACTUATED DETENT

DEDICATORY CLAUSE

The invention described herein may be manufactured, used, and licensed by or for the Government for governmental purposes without the payments to me of any royalties thereon.

BACKGROUND OF THE INVENTION

This invention relates to the field of rocket launchers. Known devices in the field consist of spring loaded members that have various arrangements of angled faces or ramps that depend on the rocket thrust to push or cam the detent to one side to achieve a release. Predictable and consistent release forces cannot be obtained due to the fact that their operation is largely dependent upon the coefficient of friction between the mating surfaces. Rocket blast and exhaust products cause this coefficient to vary widely, which accounts for the inconsistent release forces. In some applications, particularly aircraft launchers, the detent release force must be known and controlled within certain narrow ranges to make sure that a hangfire does not occur.

SUMMARY OF THE INVENTION

This invention has provided a solution to the above stated problems by incorporating features in the detent release that makes its holding power and release power not dependent upon the coefficient of friction for its operation.

The invention may be better understood from the following detailed description taken in conjunction with the accompanying drawing.

BRIEF DESCRIPTION OF THE DRAWING

The single FIGURE shown is a side view of the detent holding and release device.

DESCRIPTION OF THE PREFERRED EMBODIMENT

Reference numeral 10 identifies a rocket having a nozzle 12 and a detent groove 14. The rocket is positioned in a launch tube 16 which has an aft stop 18 attached to the inside of the tube 16 and restrains the rocket from rearward motion. An elongated spring detent 20 is attached to the outside of the tube and has a detent groove engaging member 22 extending into the groove 14 to restrain the rocket from any forward motion until the time of launch. The aft stop 18 also acts as a support for the detent and a blast actuated cam 24 that is connected to the aft stop by a pivot 26. A spring wire contact 28 is used to ignite the rocket.

In operation as a rocket 10 is loaded into the launch tube 16, the rocket comes in contact with the forward face of detent 20. This face is sloped so that the rocket pushes the detent to one side. When the rocket comes into contact with the aft stop 18, the detent engages the detent groove 14. As this operation is taking place the spring wire contact 28 engages the contact on the rocket. When the rocket is ignited, the blast of the nozzle 12 impinges on the blast actuated cam 24. This action causes the cam to rotate away from the nozzle about the pivot 26. As the rotation proceeds, the cam lifts the detent out of the detent groove 14, thereby releasing the rocket for launch.

I claim:

1. A blast actuated detent for positively restraining a rocket on a launch tube prior to launching comprising: a first restraining means disposed inside of said launch tube to restrain the rocket from rearward motion; an elongated spring detent attached to the outside of said tube, said spring detent being provided with a member extending through said launch tube to engage a detent groove on said rocket and a cam pivotally attached to said first restraining means, said cam mounted on said first restraining means and actuated by said rocket to disengage said spring detent thereby releasing said rocket for launching.

* * * * *